US007053556B2

(12) United States Patent
Yoshihara et al.

(10) Patent No.: US 7,053,556 B2
(45) Date of Patent: May 30, 2006

(54) MAGNETRON WITH A SPECIFIC DIMENSION REDUCING UNNECESSARY RADIATION

(75) Inventors: Masanori Yoshihara, Tochigi (JP); Hiroshi Ochiai, Tochigi (JP); Etsuo Saitou, Tochigi (JP); Hideki Ohguri, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/050,743

(22) Filed: Feb. 7, 2005

(65) Prior Publication Data

US 2005/0174061 A1 Aug. 11, 2005

(30) Foreign Application Priority Data

Feb. 9, 2004 (JP) ..... P. 2004-032435

(51) Int. Cl.
*H01J 25/50* (2006.01)
*H05B 6/64* (2006.01)

(52) U.S. Cl. ..... 315/39.51; 315/39.71; 315/39.75; 219/756; 219/761

(58) Field of Classification Search ..... None
See application file for complete search history.

(56) References Cited

U.S. PATENT DOCUMENTS 5,483,123 A * 1/1996 Walker et al. ..... 315/39.73
5,861,716 A * 1/1999 Ogura ..... 315/39.51
6,847,023 B1 * 1/2005 Han et al. ..... 219/756

FOREIGN PATENT DOCUMENTS

JP 6-223729 8/1994
JP 6-101304 12/1994

* cited by examiner

*Primary Examiner*—Tuyet Thi Vo
(74) *Attorney, Agent, or Firm*—McDermott Will & Emery LLP

(57) ABSTRACT

In a magnetron 41, when a radius of a flat portion 45*b* of a pole piece 45 is Rp, a radius of the inner circumference of a large-diameter equalizing ring 51 is Rs2, Rp≧Rs2, a radius of the outer circumference of a small-diameter equalizing ring is Rs1, a radius of a circle inscribed in a leading edge of an anode vane is Ra, and a minimum length between the pole pieces in the axial direction is Lg, the values of Ra, Rs1, Rs2, and Lg are set such that the following Expressions 1 and 2 are established:

$1.85Ra \leqq (Rs1+Rs2)/2 \leqq 1.96Ra$, and[Expression 1]

$2.84Ra \leqq Lg \leqq 3.0Ra$.[Expression 2]

2 Claims, 8 Drawing Sheets

MAGNETRON WITH A SPECIFIC DIMENSION REDUCING UNNECESSARY RADIATION

BACKGROUND OF THE INVENTION

The present invention relates to a magnetron used for radio-frequency heating apparatuses, such as microwave ovens.

FIG. 8 is a longitudinal cross-sectional view of a conventional magnetron incorporated into a microwave oven. FIG. 9 is an enlarged longitudinal cross-sectional view illustrating the main parts of the magnetron shown in FIG. 8. In FIGS. 8 and 9, a magnetron 1 comprises a cathode 3 vertically provided along a central axis, an anode cylindrical body 5 coaxially surrounding the cathode 3, an input pole piece 7 provided at the end of a lower opening of the anode cylindrical body 5, a cathode terminal guiding stem 31 projecting from a first metal tube 9 covering the input pole piece 7, an output pole piece 13 provided at the end of an upper opening of the anode cylindrical body 5, a second metal tube 15 covering the output pole piece 13, and a microwave radiating antenna 19 projecting from the second metal tube 15 through an insulating tube 17 made of ceramic.

A plurality of anode vanes 20 (even-numbered anode vanes) radially arranged to face the central axis of the anode cylindrical body 5 are joined to an inner wall surface of the anode cylindrical body 5. Further, a ring engaging concave portion 20*a* for joining an equalizing ring and a ring inserting concave portion 20*b* for inserting the equalizing ring without contact are provided at the upper and lower edges of each anode vane 20 in the radius direction of the anode cylindrical body 5, and the concave portions are reverse to each other in arrangement at the upper and lower edges.

Further, one of a small-diameter equalizing ring 22 and a large-diameter equalizing ring 24 both coaxially arranged with the anode cylindrical body 5 is joined to the ring engaging concave portion 20*a*, so that the anode vanes 20 arranged in the circumferential direction are electrically connected every other vane.

In a first ring-shaped permanent magnet 21 made of ferrite that surrounds the first metal tube 9 and overlaps the surface of an outer edge of the input pole piece 7, one magnetic pole thereof is magnetically connected to the input pole piece 7. In addition, in a second ring-shaped permanent magnet 23 made of ferrite that surrounds the second metal tube 15 and overlaps the surface of an outer edge of the output pole piece 13, one magnetic pole thereof is magnetically coupled to the output pole piece 13.

Furthermore, a frame-shaped yoke 25 for magnetically coupling the other magnetic pole of the first ring-shaped permanent magnet 21 to the other magnetic pole of the second ring-shaped permanent magnet 23 has a through hole 25*a* for passing through the cathode terminal guiding stem 31 at the lower end thereof.

A plurality of radiating fins 27 are mounted to the outer circumferential surface of the anode cylindrical body 5 in a multi-stage manner, and a metal filter case 29 for preventing the leakage of electromagnetic waves toward the outside of an apparatus is mounted to the outer surface of a lower end of the frame-shaped yoke 25. In addition, the cathode terminal guiding stem 31 having a diameter smaller than that of the through hole 25*a* of the frame-shaped yoke 25 is tightly soldered to the first metal tube 9. A cathode terminal 11*a* passes through the cathode terminal guiding stem 31, and the cathode terminal 11*a* is electrically connected to a lead line 11 electrically connected to the cathode 3.

A through type capacitor 33 is mounted to a side surface portion of the filter case 29, and an end of a choke coil 35 is connected to the cathode terminal 11*a* of the cathode terminal guiding stem 31 provided in the filter case 29. The choke coil 35 constitutes an LC filter circuit for preventing the leakage of electromagnetic waves, and the other end thereof is connected to a through electrode of the capacitor 33.

In the magnetron 1 having the above-mentioned structure, in order to prevent the noise leakage of a harmonic wave to the microwave radiating antenna 19, a choke ring 37 having a length of about a quarter wavelength in the axial direction is tightly brazed to the second metal tube 15.

Therefore, in the magnetron, there are restrictions for preventing the unnecessary radiation (noise leakage) of a relatively low frequency component in a range of 30 to 1000 MHz, a reference wave component (a band width and a side band level), and a harmonic wave component having a frequency larger than 4 GHz, and particularly, a strict restriction is inflicted on a fifth harmonic wave, which is a harmonic wave component.

Thus, it is difficult to completely clear the restrictions of the unnecessary radiation using only the choke ring 37.

In general, when the spectrum of a reference wave has a good waveform with little side band, the spectrum of an n-order wave (harmonic wave) is also good, so that it is possible to reduce unnecessary radiation. Further, a radius Rp (a distance from a base including a fillet of a deep-drawing tapered portion to the central axis of the magnetron, that is, a distance from an intersection of a virtual extension line of the flat portion and a virtual extension line of the deep-drawing tapered portion to the central axis of the magnetron) of a small-diameter flat portion of a pole piece formed in a funnel shape by deep drawing greatly affects the generation of the side band on the spectrum of the reference wave.

The flat portion of each pole piece 7 or 13 is a flat area close to the end surface of each anode vane 20 for concentrating a magnetic flux on an operation space in the anode cylindrical body 5, and the variation of the reference wave spectrum is shown in FIGS. 10A to 10E when the radius Rp of the flat portion is gradually increased.

Further, when a radius of the outer circumference of the small-diameter equalizing ring 22 is Rs1, a radius of the inner circumference of the large-diameter equalizing ring 24 is Rs2, and a minimum length Lg between upper and lower pole pieces in the axial direction is two-point-eight times as large as a radius Ra of a circle inscribed in a leading edge of the anode vane 20, the radius Rp of the flat portion increases on the basis of the radiuses Rs1 and Rs2 of the respective equalizing rings 22 and 24, and the reference spectrums measured at that time are shown in FIGS. 10A to 10E.

FIG. 10A shows a spectrum when Rp<Rs1, FIG. 10B shows a spectrum when Rp=Rs1, FIG 10C shows a spectrum when Rp=(Rs1+Rs2)/2, FIG. 10D shows a spectrum when Rp=Rs2, and FIG. 10E shows a spectrum when Rp>Rs2.

As can be seen from FIGS. 10A to 10E, when the radius Rp of the flat portion of the pole piece is large, the generation of the side band is correspondingly reduced, and thus a good spectrum is obtained. Actually, when measuring a noise level in the vicinity of a frequency of 2.4 GHz, the noise level is rapidly attenuated if the radius Rp of the flat portion is larger than the radius Rs1 of the outer circumference of the small-diameter equalizing ring 22, as shown in FIG. 11.

Therefore, in the conventional art, from this point of view, the radius Rp of the flat portion of the pole piece is generally set to be equal to or larger than the radius Rs2 of the inner circumference of the large-diameter equalizing ring 24, thereby preventing the leakage of unnecessary waves.

Further, as a countermeasure for noise, there has been proposed a method in which the length of the anode vane in the axial direction is set to be smaller than 70% of the minimum length between the pole pieces in the axial direction (between central flat portions), so that the distribution of the strength of a magnetic filed in the operation space is uniformed in the axial direction, thereby reducing a so-called line noise (for example, see Japanese Unexamined Patent Application Publication No. 6-223729).

As described above, in the conventional magnetron, the radius Rp of the flat portion of the pole piece is set to be equal to or larger than the radius Rs2 of the inner circumference of the large-diameter equalizing ring 24, thereby preventing the leakage of unnecessary waves. However, such a structure has another problem in that oscillation efficiency deteriorates on the other side.

Further, in the magnetron described in Patent Document 1, a reduction in line noise is achieved, but oscillation efficiency is not improved.

In order to prevent the leakage of unnecessary waves and to improve oscillation efficiency, the present inventors analyzed the relationship between the minimum length between the upper and lower pole pieces in the axial direction and the radius of each anode vane or each equalizing ring in detail, and obtained new knowledge.

SUMMARY OF THE INVENTION

The present invention has been made to solve the above-mentioned problems in consideration with the above knowledge, and it is an object of the present invention to provide a magnetron capable of sufficiently reducing unnecessary radiation and of improving oscillation efficiency.

In order to achieve the above object, according to a first aspect, the present invention provides a magnetron comprising: an anode cylindrical body; a plurality of anode vanes provided to project from an inner wall surface of the anode cylindrical body toward a central axis; a large-diameter equalizing ring and a small-diameter equalizing ring for electrically connecting the plurality of vanes every other vane; and a pair of funnel-shaped pole pieces provided at ends of both openings of the anode cylindrical body in an axial direction, wherein a radius Rp of a flat portion of the pole piece closer to an upper or lower edge of the anode vane is equal to or larger than a radius Rs2 of an inner circumference of the large-diameter equalizing ring; and wherein, when a radius of an outer circumference of the small-diameter equalizing ring is Rs1, a radius of the inner circumference of the large-diameter equalizing ring is Rs2, a radius of a circle inscribed in a leading edge of the anode vane is Ra, and a minimum length between the pole pieces in the axial direction is Lg, the values of Ra, Rs1, Rs2, and Lg are set so as to satisfy the following Expressions 1 and 2:

$$1.85Ra \leqq (Rs1+Rs2)/2 \leqq 1.96Ra, \text{ and} \quad \text{[Expression 1]}$$

$$2.84Ra \leqq Lg \leqq 3.0Ra. \quad \text{[Expression 2]}$$

According to the analysis of the present inventors, the unnecessary radiation and oscillation efficiency of the magnetron is slightly affected by the ratios of the radius Rp of the flat portion of the pole piece to the radius Rs1 of the outer circumference of the small-diameter equalizing ring, the radius Rs2 of the inner circumference of the large-diameter equalizing ring, and the radius Ra of the circle inscribed in the leading edge of the anode vane as well as the radius Rp of the flat portion of the pole piece.

For example, the noise leakage amount of the fifth harmonic wave has a downwardly convex curve characteristic where the leakage amount is minimum in the vicinity of [(Rs1+Rs2/2)]÷Ra=1.90. Therefore, the values of Rs1, Rs2, and Ra are set such that [(Rs1+Rs2/2)]÷Ra is included within the proper range in the vicinity of the minimum value, and thus it is possible to minimize noise leakage and to sufficiently reduce unnecessary radiation.

Furthermore, oscillation efficiency has an inflection point in the vicinity of a point where the radius Rp of the flat portion closer to the anode vane of the funnel-shaped pole piece is larger than the radius Rs2 of the inner circumference of the large-diameter equalizing ring. When the radius of the flat portion becomes larger than the radius corresponding to the inflection point, the operating efficiency is rapidly lowered. However, even in a clean spectrum where the radius Rp of the flat portion is larger than the radius Rs2 of the inner circumference of the large-diameter equalizing ring, the present invention makes it possible to prevent a reduction in oscillation efficiency by optimizing the minimum length Lg between the pole pieces in the axial direction. That is, when the minimum length Lg between the upper and lower pole pieces in the axial direction is set within a proper range of 2.84Ra<Lg<3.0Ra, high oscillation efficiency can be obtained in the clean spectrum where the radius Rp of the flat portion is larger than the radius Rs2 of the inner circumference of the large-diameter equalizing ring.

Therefore, when the values of Ra, Rs1, Rs2, and Lg are set in the setting ranges of Expressions 1 and 2, the reference wave component has the clean spectrum, and it is possible to sufficiently reduce the unnecessary radiation of harmonic wave components and relatively low frequency components having a frequency range of 30 to 1000 MHz. Thus, it is possible to prevent a reduction in oscillation efficiency and to improve the oscillation efficiency.

Furthermore, preferably, in the magnetron, the length of each anode vane in the axial direction is set to be about two times larger than the radius Ra. In addition, when a length between outer circumferences of upper and lower end parts in the axial direction is Lk, the value of Lk is set to satisfy the following Expression 3:

$$2.3Ra \leqq Lk \leqq 2.4Ra. \quad \text{[Expression 3]}$$

As such, it is possible to stably secure a dark current characteristic and load stability determining the reliability of a magnetron by optimizing the length between the outer circumferences of the upper and lower end parts in the axial direction.

DETAILED DESCRIPTION OF THE PREFERRED EMBODIMENTS

Hereinafter, a preferred embodiment of a magnetron according to the present invention will be described in detail with reference to the accompanying drawings.

Figure 1:
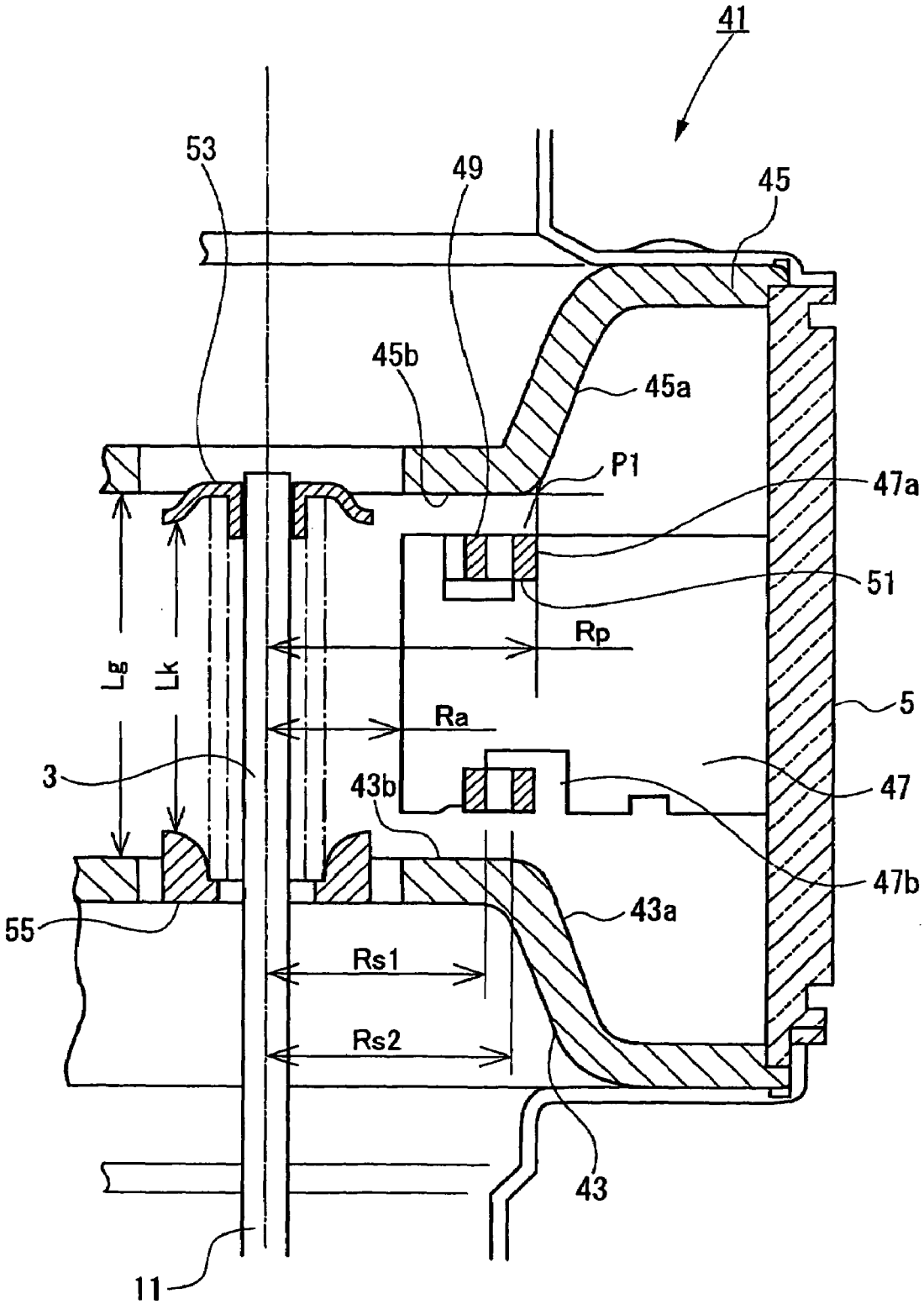
FIG. 1 is a longitudinal cross-sectional view showing a magnetron according to an embodiment of the present invention.

FIG. 1 is a longitudinal sectional view illustrating a magnetron according to an embodiment of the present invention.

Figure 8:
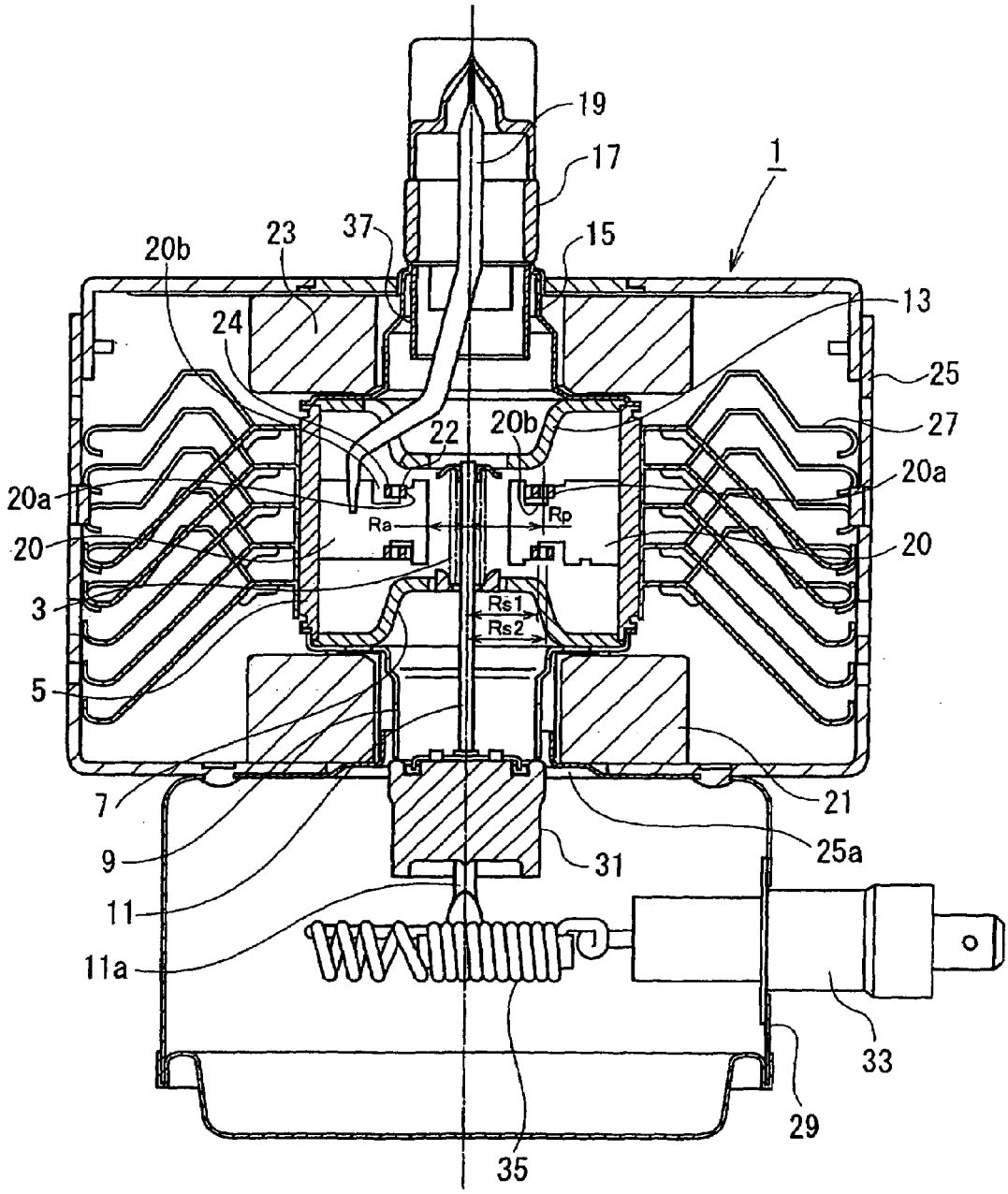
FIG. 8 (PRIOR ART)
FIG. 8 is a longitudinal cross-sectional view of a conventional magnetron.
Figure 9:
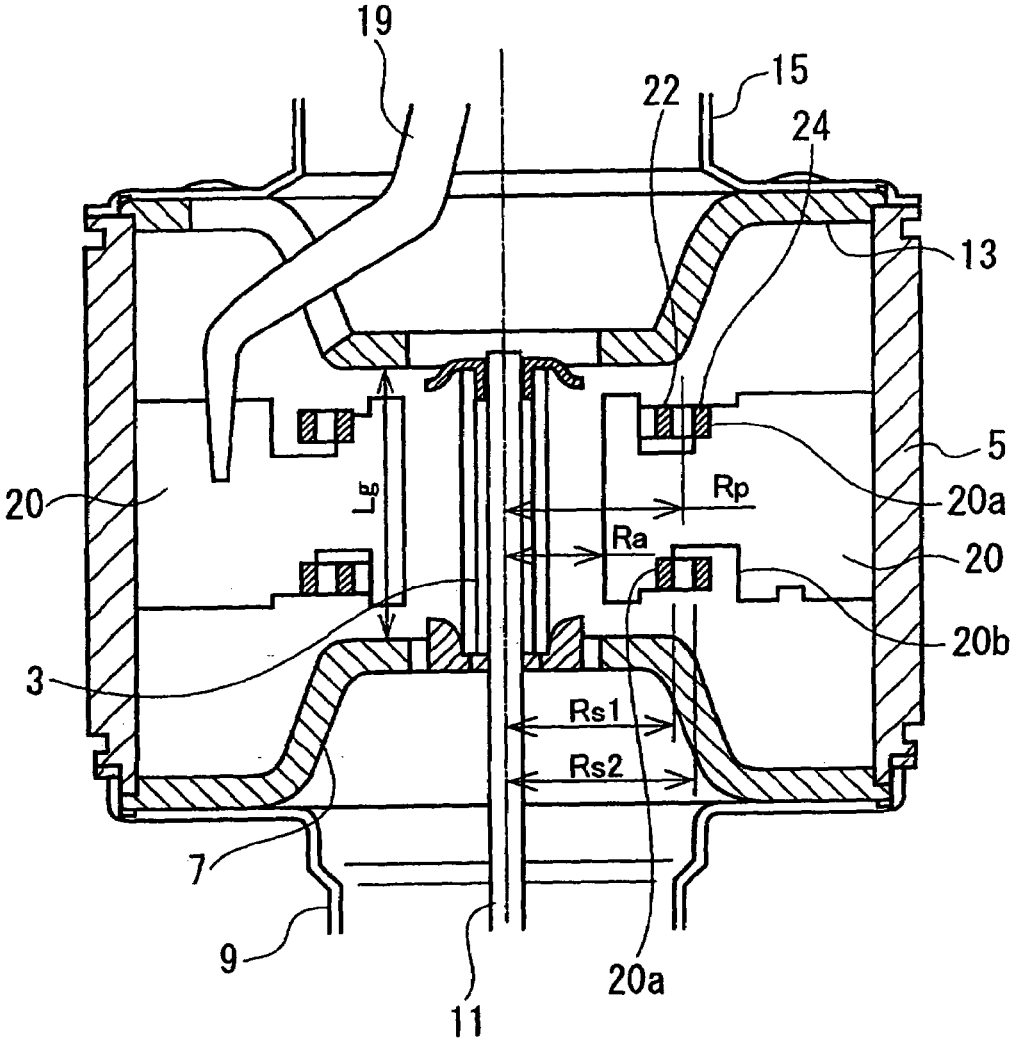
FIG. 9 (PRIOR ART)
FIG. 9 is a longitudinal cross-sectional view illustrating the main parts of the conventional magnetron.
Figure 10A:
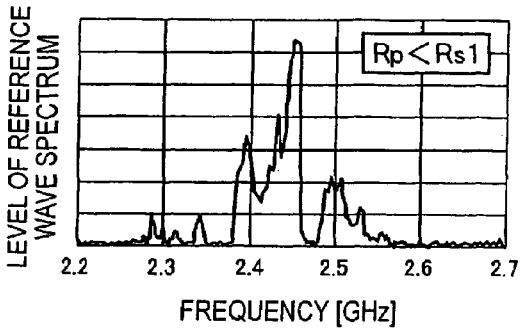
FIG. 10A (PRIOR ART)
FIGS. 10A to 10E are graphs illustrating an aspect in which the generation of a side band is reduced on a reference wave spectrum with an increase in the radius of the flat portion of the pole piece of the magnetron.
Figure 10B:
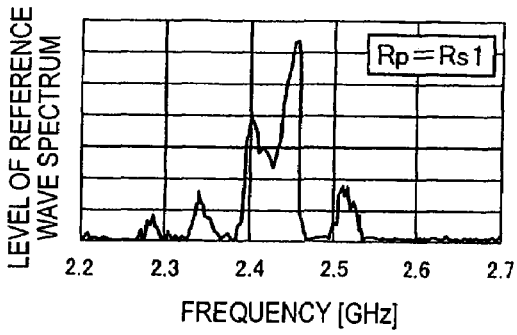
FIG. 10B (PRIOR ART)
Figure 10C:
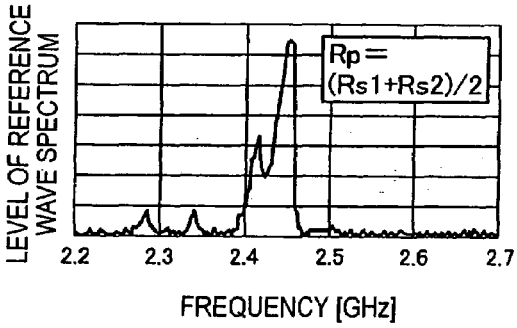
FIG. 10C (PRIOR ART)
Figure 10D:
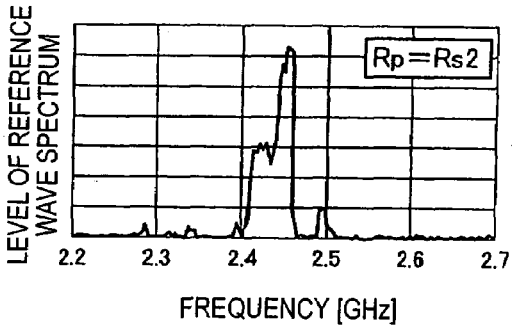
FIG. 10D (PRIOR ART)
Figure 10E:
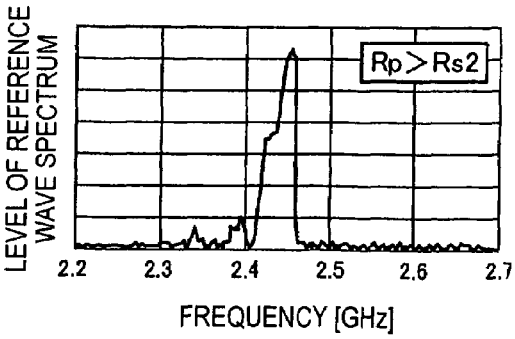
FIG. 10E (PRIOR ART)
Figure 11:
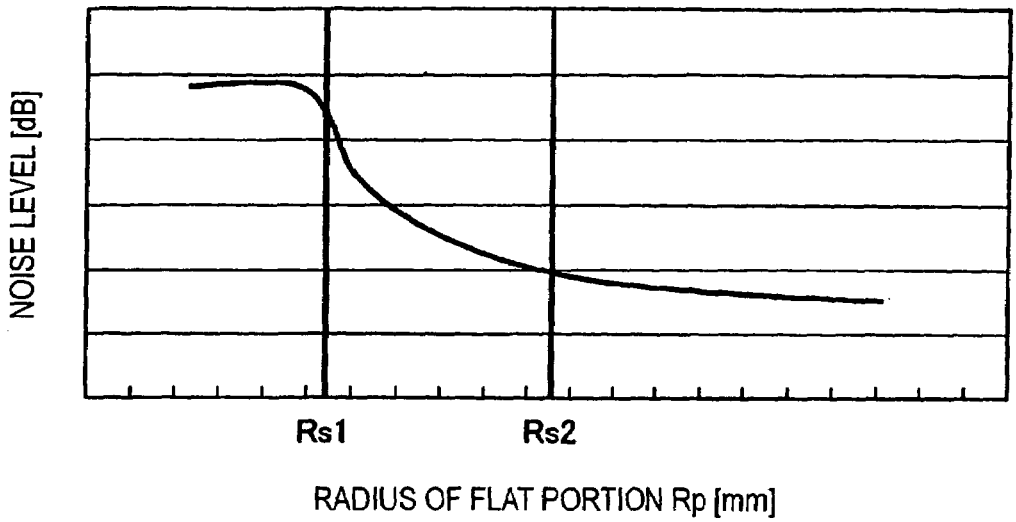
FIG. 11 (PRIOR ART)
FIG. 11 is a graph illustrating the correlation between a noise level and the radius of the flat portion of the pole piece of the magnetron.

A magnetron 41 according to an embodiment of the present invention has the same structure as a conventional magnetron 1 shown in FIGS. 8 and 9 except that an input pole piece 7 is replaced with an input pole piece 41, an output pole piece 13 with an output pole piece 45, an anode vane 20 with an anode vane 47, a small-diameter equalizing ring 22 with a small-diameter equalizing ring 49, and a large-diameter equalizing ring 24 with a large-diameter equalizing ring 51. In the present embodiment, the same components as those in the conventional magnetron have the same reference numerals, and thus a description thereof will be omitted for the simplicity of explanation.

In the magnetron 41 of the present embodiment, a radius Rp of the small-diameter flat portion 43*b* or 45*b* from a central axis of the magnetron to an intersection P1 of a virtual extension line of a deep-drawing tapered portion 43*a* or 45*a* of the pole piece 43 formed in a funnel shape by deep drawing and a virtual extension line of a flat portion 43*b* or 45*b* close to the circumference of an upper end of each anode vane 47 is equal to or greater than a radius Rs2 of the inner circumference of the large-diameter equalizing ring 51, and proper dimension ratios of the input pole piece 43, the output pole piece 45, the anode vane 47, the small-diameter equalizing ring 49, and the large-diameter equalizing ring 51 with respect to a radius Ra of a circle inscribed in a leading edge of the anode vane 47 are calculated.

That is, in the magnetron 41 according to the present embodiment, the pole pieces 43 and 45 are tightly joined to lower and upper ends of an anode cylindrical body 5 vertically arranged with respect to the central axis of the magnetron, respectively, and a plurality of the anode vanes 47 is joined to an inner wall surface of the anode cylindrical body 5 so as to be radially arranged facing the central axis of the anode cylindrical portion 5. In addition, a ring engaging concave portion 47*a* for joining a small and large equalizing rings and a ring inserting concave portion 47*b* for inserting the small and large equalizing rings without contact are respectively provided in upper and lower edges of each anode vane 47 in the radius direction of the anode cylindrical body 5 such that the upper end and lower edges of the concave portions are opposite to each other in arrangement.

Further, the small-diameter equalizing ring 49 or the large-diameter equalizing ring 51 coaxially arranged with the central axis of the anode cylindrical body 5 is joined to the ring engaging concave portions 47*a* of the respective anode vanes 47, so that the anode vanes 47 arranged in the circumferential direction are electrically connected every other vane. In addition, a microwave irradiating antenna (see reference numeral 19 in FIG. 8) is joined to the upper edge of one of the plurality of anode vanes 47 so as to pass through the output pole piece 45 without contact.

Furthermore, when a radius of the outer circumference of the small-diameter equalizing ring 49 is Rs1, a radius of the inner circumference of the large-diameter equalizing ring 51 is Rs2, a radius of a circle inscribed in the leading end of the anode vane 47 is Ra, and a minimum length between the input pole piece 43 and the output pole piece 45 in the axial direction is Lg, the values of Ra, Rs1, Rs2, and Lg are set such that the following Expressions 1 and 2 are established:

$$1.85Ra \leqq (Rs1+Rs2)/2 \leqq 1.96Ra, \text{ and} \quad \text{[Expression 1]}$$

$$2.84Ra \leqq Lg \leqq 3.0Ra. \quad \text{[Expression 2]}$$

Moreover, in the magnetron 41 according to the present embodiment, the length of each anode vane 47 in the axial direction is about two times larger than the radius Ra of the circle inscribed in the leading end of the anode vane 47. When the length between the outer circumferences of an upper end part 53 and a lower end part 55 respectively supporting upper and lower ends of a cathode 3 in the axial direction is Lk, the value of Lk is set so as to satisfy the following Expression 3:

$$2.3Ra \leqq Lk \leqq 2.4Ra. \quad \text{[Expression 3]}$$

Further, the intersection P1 is positioned on the virtual extension line of the tapered portion 45*a* and the virtual extension line of the flat portion 45*b* due to a fillet (R portion) generated when deep drawing is performed on the output pole piece 45 (or the input pole piece 43). However, if the process can be performed without generating the fillet, the base between the tapered portion 45*a* and the flat portion 45*b* is used as the intersection P1.

Figure 2:
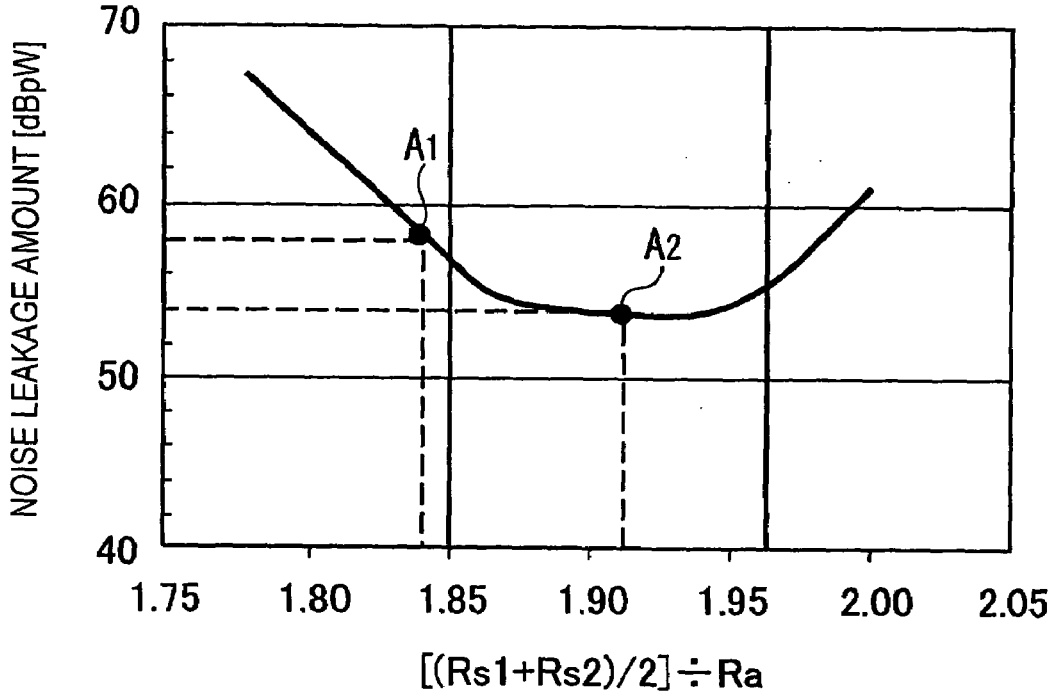
FIG. 2 is a graph illustrating the relationship between the dimensions of an equalizing ring and the noise of a fifth harmonic wave according to the embodiment of the present invention.

In the magnetron 41 of the present embodiment having the above-mentioned structure, according to the prevent inventors' examination and analysis, as shown at a point A2 of FIG. 2, the leakage amount of the harmonic wave noise including the fifth harmonic wave noise has a downwardly convex curve characteristic where the leakage amount is minimum in the vicinity of [(Rs1+Rs2/2)]÷Ra=1.90, and the values of Rs1, Rs2, and Ra are set in the range where Expression 1 is satisfied. Therefore, it is possible to minimize the noise leakage amount of the fifth harmonic wave in a range of 54 to 55 dBpW.

Figure 3:
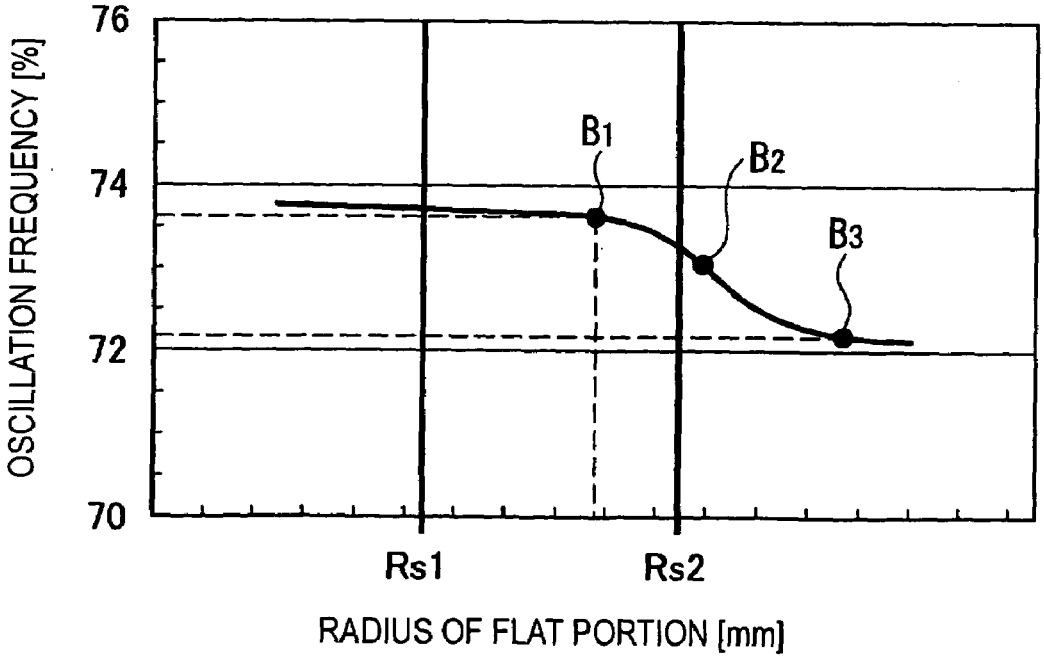
FIG. 3 is a graph illustrating the relationship between the dimensions of a flat portion of a pole piece and oscillation efficiency according to the embodiment of the present invention.
Figure 4:
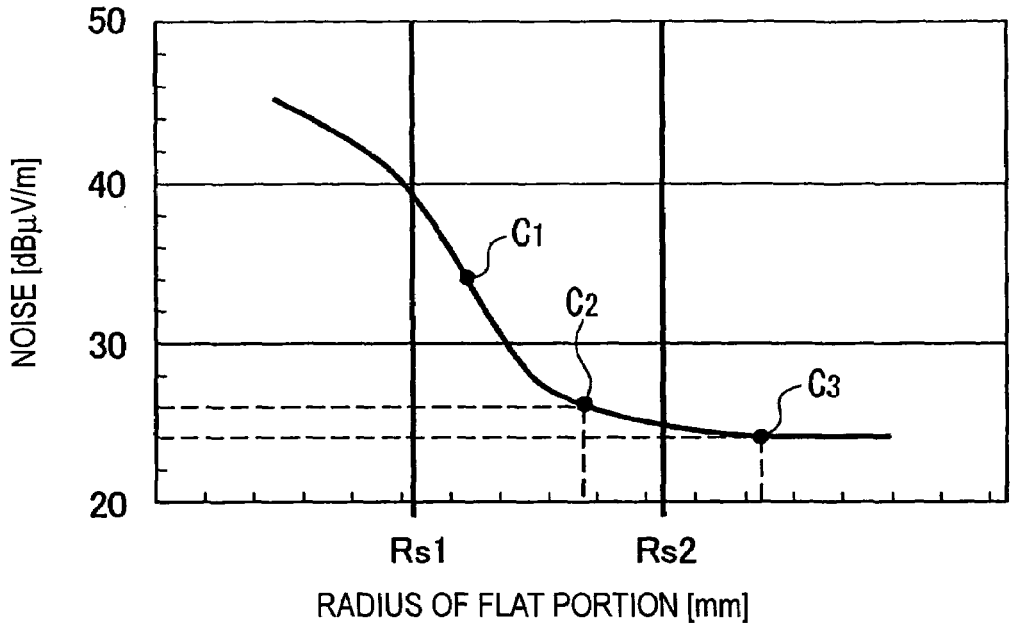
FIG. 4 is a graph illustrating the relationship between the dimensions of the flat portion of the pole piece and the noise of a frequency band of 50 MHz according to the embodiment of the present invention.

Further, as shown in FIG. 3, oscillation efficiency has an inflection point B2 in the vicinity of a point where the radius Rp of the flat portion 43*b* or 45*b* of the pole piece 43 or 45 is larger than the radius Rs2 of the inner circumference of the large-diameter equalizing ring 51. When the radius of the flat portion becomes larger than the radius corresponding to the inflection point B2, the operating efficiency is rapidly lowered. However, as shown in FIG. 4, the noise of a low-frequency band of 50 MHz has an inflection point C1 in the vicinity of the radius Rs1 of the outer circumference of the small-diameter equalizing ring 49. When the radius of the flat portion is smaller than the radius corresponding to the inflection point C1, the noise rapidly increases. When the radius of the flat portion is equal to or larger than the radius Rs2, for example, the radius corresponding to an inflection point C3, a low-frequency characteristic is stabilized. In addition, when the value of Rp is equal to or greater than the value of Rs2, the noise level of a frequency of 2.4 GHz indicating a reference wave band characteristic has a stabilized low-noise characteristic as shown in FIG. 10.

Figure 5:
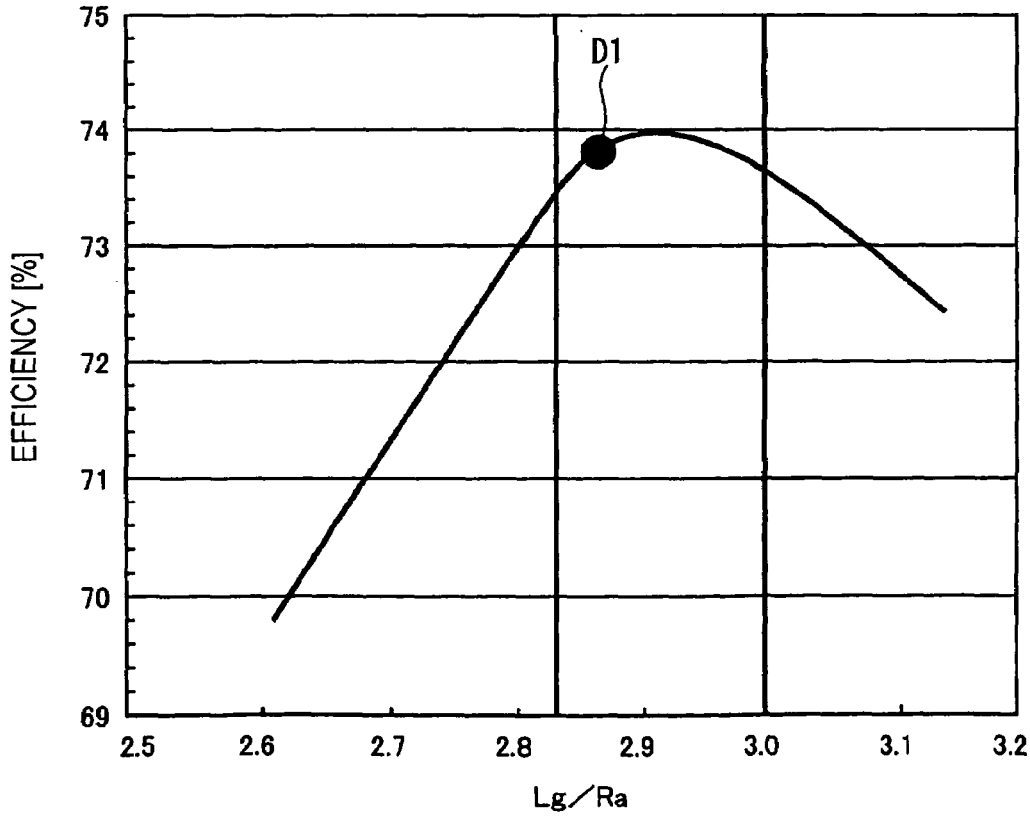
FIG. 5 is a graph illustrating the relationship between oscillation efficiency and the dimensions between upper and lower pole pieces according to the embodiment of the present invention.

FIG. 5 shows a case in which the minimum length Lg between the upper and lower pole pieces in the axial direction is optimized to improve the oscillation efficiency while maintaining the stabilized low-noise characteristic.

The relationship between the oscillation efficiency and the length between the pole pieces in the axial direction has an upwardly convex curve characteristic where a maximum value is obtained in the vicinity of Lg÷Ra=2.95, and the values of Ra, Rs1, Rs2, Rp, and Lg are set such that Expression 2 is established. Therefore, it is possible to improve oscillation efficiency and to prevent the noise leakage of a low-frequency band.

Furthermore, as for the minimum length Lg between the upper and lower pole pieces in the axial direction, a difference between a design value and an actual length is in a range of about 0.05 mm to 0.15 mm. The actual length is set to be smaller than the design value because, when first and second metal tubes 9 and 15 are tightly welded to the anode cylindrical body 5, both end portions of the anode cylindrical body 5 softened by an increase in temperature are deformed in the axial direction since force is applied to the anode vane 47 to tightly join the respective components. In the present embodiment, the length Lg is represented by the actual length.

That is, in the magnetron 41 according to the present embodiment, the values of Rs1, Rs2, and Ra are set to satisfy Expression 1, and thus it is possible to restrict the leakage amount of the harmonic wave noise including the fifth harmonic wave noise below a predetermined level. Further, the values of Ra and Lg are set to satisfy Expression 2, and thus it is possible to improve oscillation efficiency and to prevent the noise leakage of a low-frequency band. Finally, it is possible to sufficiently reduce unnecessary radiation in the overall frequency band, and to prevent a reduction in oscillation efficiency, thereby improving the oscillation efficiency.

Figure 6:
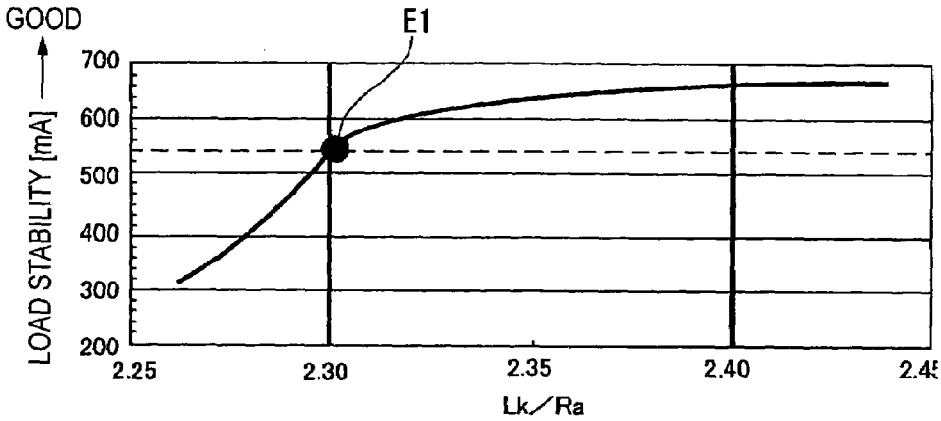
FIG. 6 is a graph illustrating the relationship between load stability and the dimensions between the outer circumferences of upper and lower end parts according to the embodiment of the present invention.

Furthermore, the length of each anode vane 47 in the axial direction is about two times larger than the radius Ra of the circuit inscribed in the leading end of the anode vane 47. When the length between the outer circumferences of the upper and lower end parts in the axial direction is Lk, in the relationship between the value of Lk and load stability, as shown in FIG. 6, the load stability rapidly deteriorates in the range where the value of Lk/Ra is below an inflection point E1, that is, smaller than 2.3. This is an important characteristic to determine the reliability of a magnetron and refers to an average anode current value where moding is generated from a load seen from the magnetron (VSWR: 4.0, all phases). When the average anode current value is larger than 550 mA, from the past results, no problem occurs from microwave ovens on the market.

Figure 7:
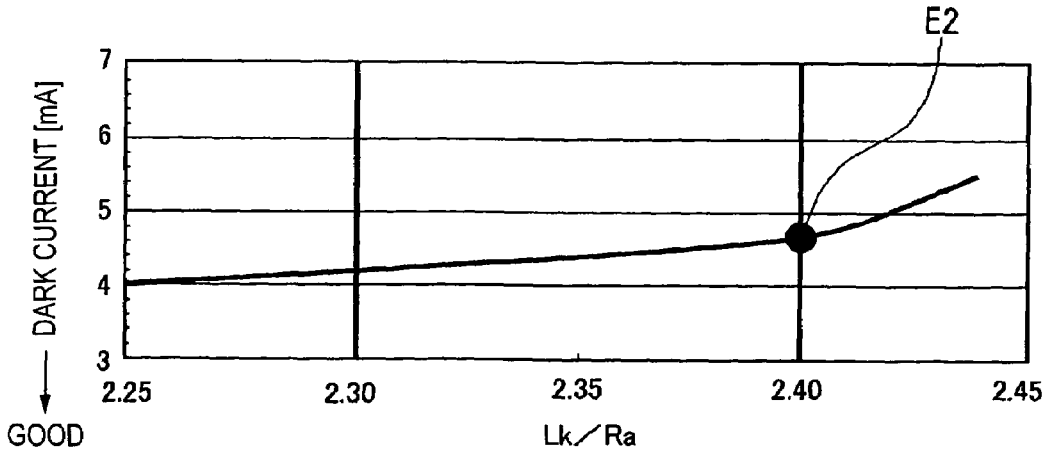
FIG. 7 is a graph illustrating the relationship between a dark current and the dimensions between the outer circumferences of the upper and lower end parts according to the embodiment of the present invention.

Similarly, when a dark current is considered, the dark current rapidly deteriorates if the value of Lk/Ra is larger than an inflection point E2 where Lk/Ra is 2.4 as shown in FIG. 7. When the dark current is large, problems, such as the deterioration of oscillation efficiency and the turbulence of a reference spectrum, occur.

According to a comparative experiment by the present inventors, in case of the conventional magnetron in which the radiuses of the respective components are set such that the relationships Rp≧Rs2, Lg÷Ra=2.78, and [(Rs1+Rs2)/2]÷Ra=1.84 are established, a reference wave side band is not generated, and a good spectrum is confirmed. Further, the following results are obtained: oscillation efficiency is 72.2% as shown at a point B3 of FIG. 3, the noise of the fifth harmonic wave is 59 dBpW as shown at a point A1 of FIG. 2, and the noise of a frequency band of 50 MHz is 24 dBμV/m as shown at a point C3 of FIG. 4.

On the other side, in case of the magnetron according to the present invention in which the radiuses of the respective components are set such that the relationships Rp≧Rs2, Lg÷Ra=2.86, and [(Rs1+Rs2)/2]÷Ra=1.91 are established, the reference wave side band is not generated, and a good spectrum is not confirmed. However, the following results are obtained: the oscillation efficiency is 73.8% as shown at a point D1 of FIG. 5, the noise of the fifth harmonic wave is 54 dBpW as shown at a point A2 of FIG. 2, and the noise of a frequency band of 50 MHz is 24 dBμV/m as shown at the point C3 of FIG. 4. That is, it is confirmed that the oscillation efficiency is improved by 1.6% and that the noise of the fifth harmonic wave is improved by 5 dB. Thus, the results prove that the present invention has usefulness.

Further, in a magnetron having the same structure and dimensions as those described above except the relationship Rs1<Rp<Rs2, the following results are obtained: oscillation efficiency is 73.6% as shown at a point B1 of FIG. 3, the noise of the fifth harmonic wave is 54 dBpW as shown at the point A2 of FIG. 2, and the noise of a frequency band of 50 MHz is 26 dBμV/m as shown at a point C2 of FIG. 4. That is, it is confirmed that the noise of the frequency band of 50 MHz is increased by 2 dB, and that the reference wave spectrum deteriorates.

As described above, according to the magnetron 41 of the present embodiment, the values of Rs1, Rs2, and Ra are set such that Expression 1 is satisfied under the optimum condition of a reference wave, such as Rp≧Rs2. Therefore, it is possible to restrict the leakage amount of the harmonic wage noise including the fifth harmonic wave noise below a predetermined level. Further, since the values of Ra and Lg are set so as to satisfy Expression 2, it is possible to improve oscillation efficiency and to prevent the noise leakage of a low-frequency band. Finally, it is possible to sufficiently reduce unnecessary radiation in the overall frequency band and to prevent a reduction in oscillation efficiency, thereby improving oscillation efficiency.

Furthermore, since the length Lk between the outer circumferences of the upper and lower end parts in the axial direction is optimized, it is possible to secure a stable dark current characteristic and load stability determining the reliability of the magnetron 41.

INDUSTRIAL APPLICABILITY

The present invention can be applied to magnetrons for microwave ovens.

What is claimed is:

1. A magnetron comprising:

an anode cylindrical body;

a plurality of anode vanes provided to project from an inner wall surface of the anode cylindrical body toward a central axis;

a large-diameter equalizing ring and a small-diameter equalizing ring for electrically connecting the plurality of vanes to every other vane; and a pair of funnel-shaped pole pieces provided at ends of both openings of the anode cylindrical body in an axial direction, wherein a radius Rp of a flat portion of the pole piece closer to an upper or lower edge of the anode vane is equal to or larger than a radius Rs2 of an inner circumference of the large-diameter equalizing ring, and when a radius of an outer circumference of the small-diameter equalizing ring is Rs1, a radius of the inner circumference of the large-diameter equalizing ring is Rs2, a radius of a circle inscribed in a leading edge of the anode vane is Ra, and a minimum length between the pole pieces in the axial direction is Lg, the values of Ra, Rs1, Rs2, and Lg are set so as to satisfy the following Expressions 1 and 2:

$$1.85Ra \leqq (Rs1+Rs2)/2 \leqq 1.96Ra, \text{ and} \quad \text{[Expression 1]}$$

$$2.84Ra \leqq Lg \leqq 3.0Ra. \quad \text{[Expression 2]}$$

2. The magnetron according to claim 1, wherein the length of each anode vane in the axial direction is set to be about two times larger than the radius Ra, and when a length between outer circumferences of upper and lower end parts in the axial direction is Lk, the value of Lk is set to satisfy the following Expression 3:

$$2.3Ra \leqq Lk \leqq 2.4Ra. \quad \text{[Expression 3]}$$

* * * * *